US008205354B2

(12) United States Patent
Polegato Moretti

(10) Patent No.: US 8,205,354 B2
(45) Date of Patent: Jun. 26, 2012

(54) SOLE FOR SHOES OF THE WATERPROOF AND VAPOR-PERMEABLE TYPE, AND SHOE PROVIDED WITH SAID SOLE

(75) Inventor: Mario Polegato Moretti, Crocetta Del Montello (IT)

(73) Assignee: Geox S.p.A., Montebelluna (IT)

( * ) Notice: Subject to any disclaimer, the term of this patent is extended or adjusted under 35 U.S.C. 154(b) by 648 days.

(21) Appl. No.: 12/304,171

(22) PCT Filed: May 31, 2007

(86) PCT No.: PCT/EP2007/004830

§ 371 (c)(1),
(2), (4) Date: Dec. 10, 2008

(87) PCT Pub. No.: WO2007/144073

PCT Pub. Date: Dec. 21, 2007

(65) Prior Publication Data

US 2009/0193690 A1 Aug. 6, 2009

(30) Foreign Application Priority Data

Jun. 14, 2006 (IT) ..... TV2006A0104

(51) Int. Cl.
*A43B 7/06* (2006.01)
*A43B 13/12* (2006.01)

(52) U.S. Cl. ..... 36/3 B; 36/30 R; 36/14

(58) Field of Classification Search ..... 36/3 B, 36/30 R, 14, 12, 3 A, 103
See application file for complete search history.

(56) References Cited

U.S. PATENT DOCUMENTS

| | | | | |
|---|---|---|---|---|
| 3,383,782 | A * | 5/1968 | McGinnity | 36/3 A |
| 5,044,096 | A * | 9/1991 | Polegato | 36/3 R |
| 6,874,251 | B2 * | 4/2005 | Moretti | 36/3 B |
| 7,367,141 | B2 * | 5/2008 | Polegato Moretti | 36/3 B |
| 7,823,297 | B2 * | 11/2010 | Polegato Moretti | 36/3 R |
| 2001/0010127 | A1 | 8/2001 | Polegato Moretti | |
| 2005/0126036 | A1 | 6/2005 | Wu | |
| 2005/0252035 | A1 * | 11/2005 | Moretti et al. | 36/3 B |

FOREIGN PATENT DOCUMENTS

| | | |
|---|---|---|
| WO | WO 2004028284 A1 * | 4/2004 |
| WO | 2006 010578 | 2/2006 |

OTHER PUBLICATIONS

U.S. Appl. No. 12/302,852, filed Nov. 28, 2008, Poligato Moretti.
U.S. Appl. No. 13/091,355, filed Apr. 21, 2011, Polegato Moretti, et al.

* cited by examiner

*Primary Examiner* — Ted Kavanaugh
(74) *Attorney, Agent, or Firm* — Oblon, Spivak, McClelland, Maier & Neustadt, L.L.P.

(57) ABSTRACT

A sole for shoes, of waterproof and vapor-permeable type, including a lower element of plastic material, with formed thereon a tread with multiple through holes, a water impermeable and permeable to water vapor membrane arranged above the lower element and superimposed on the through holes, the membrane being joined perimetrically and hermetically to at least one component of the sole to avoid rise of liquids through the sole, and a vapor-permeable or perforated mechanism protecting the membrane, arranged below the membrane superimposed on the area of the holes. The sole includes individual vapor-permeable or perforated protective elements, each arranged so as to block a corresponding through hole. The lower element forms, for each through hole, an undercut region for preventing downward extraction for each protective element.

31 Claims, 4 Drawing Sheets

SOLE FOR SHOES OF THE WATERPROOF AND VAPOR-PERMEABLE TYPE, AND SHOE PROVIDED WITH SAID SOLE

TECHNICAL FIELD

The present invention relates to a sole for shoes of the waterproof and vapor-permeable type.

The present invention also relates to a shoe provided with said sole.

BACKGROUND ART

As is known, most of the perspiration of the foot originates at the interface between the sole of the foot and the sole of the shoe, and the perspiration that forms there, being unable to evaporate, condenses on the plantar insert on which the foot rests; only a minimal part of the perspiration evaporates through the upper.

This phenomenon is particularly conspicuous in shoes which have a rubber sole; in these cases, vapor permeation through the sole is prevented completely.

In order to solve this problem, shoes with soles which are waterproof and vapor-permeable (permeable to water vapor) and are made of plastic material have now been devised for several years.

Their purpose is to allow the escape of the water vapor produced by the foot with perspiration.

One of the solutions is disclosed for example in U.S. Pat. No. 5,044,096 and EP 382904 and consists in dividing the rubber sole into two layers provided with through holes (the tread is associated with the lower layer) and in interposing a membrane which is waterproof and vapor-permeable and is connected perimetrically and hermetically to the two layers so as to not allow water infiltrations.

It is convenient to arrange below the membrane a layer for protecting it (for example a felt layer), as disclosed for example in U.S. Pat. No. 5,983,524 and EP 858270.

The need to prevent foreign objects of a certain size from being able to arrange themselves inside the holes, with the possibility of damaging both the felt and the membrane, forces the use of holes having a size of 1.5-2.0 mm, which are spaced enough to avoid compromising the structural strength of the tread, thus reducing the vapor permeation area.

One optimum solution meant to increase the vapor permeation area of the tread is disclosed for example in U.S. Ser. No. 10/527,187 and in EPA 03769286.0.

The type of sole disclosed in this last patent application is particularly adapted to dissipate the large amounts of water vapor that form, with perspiration, inside the shoes of individuals who have higher-than-average perspiration.

Excessive foot perspiration can also occur in the case of extremely hot and humid climates and if shoes are used for sports activities.

The cited patent application discloses a sole which has a structure comprising a supporting layer which, at least in a preset large portion, is provided by means of a net (made of synthetic or metallic material).

A membrane made of a material which is impermeable to water and permeable to water vapor is associated in an upward region with the supporting layer at least in the provided large net portion, which it covers.

A plastic tread with at least one large through hole at the provided large portion is joined hermetically to the membrane and to the supporting layer at least at the perimeter of the large net portion; typically, the tread is overmolded on the net.

This solution, as mentioned, allows to utilize at best the characteristics of the waterproof and vapor-permeable membrane, but in certain applications a sole which has a large net may be too rigid or may have a limited capacity to absorb impacts with the ground.

DISCLOSURE OF THE INVENTION

The aim of the present invention is to provide a sole for shoes of the waterproof and vapor-permeable type which solves the problems described in known types.

Within this aim, an important object of the present invention is to provide a sole for shoes of the waterproof and vapor-permeable type which allows to increase the vapor permeation area at the tread without reducing the characteristics of resistance to piercing of the protective means arranged below the membrane and without compromising characteristics of flexibility and shock-absorption of the sole.

Another object of the present invention is to provide a shoe which maximizes vapor permeation without compromising the comfort related to its flexibility and softness.

This aim and these and other objects, which will become better apparent hereinafter, are achieved by a sole for shoes, of the waterproof and vapor-permeable type, which comprises:

- a lower element made of plastic material, on which a tread provided with a plurality of through holes is formed;
- a membrane which is impermeable to water and permeable to water vapor and is arranged above said lower element so as to be superimposed on said through holes, said membrane being joined perimetrically and hermetically to at least one component of the sole so as to avoid the rise of liquids through said sole,
- vapor-permeable or perforated membrane protection means, which are arranged below said membrane so as to be superimposed on the area of said holes, characterized in that said means for protecting the membrane comprise individual vapor-permeable or perforated protective elements, each arranged so as to block a corresponding said through hole, said lower element forming, for each of said through holes, an undercut region for preventing downward extraction for each of said protective elements.

BRIEF DESCRIPTION OF THE DRAWINGS

Further characteristics and advantages of the invention will become better apparent from the description of some preferred but not exclusive embodiments thereof, illustrated by way of non-limiting example in the accompanying drawings, wherein.

In the exemplary embodiments that follow, individual characteristics, given in relation to specific examples, may actually be interchanged with other different characteristics that exist in other exemplary embodiments.

Moreover, it is noted that anything found to be already known during the patenting process is understood not to be claimed and to be the subject of a disclaimer.

WAYS TO CARRYING OUT THE INVENTION

Figure 1:
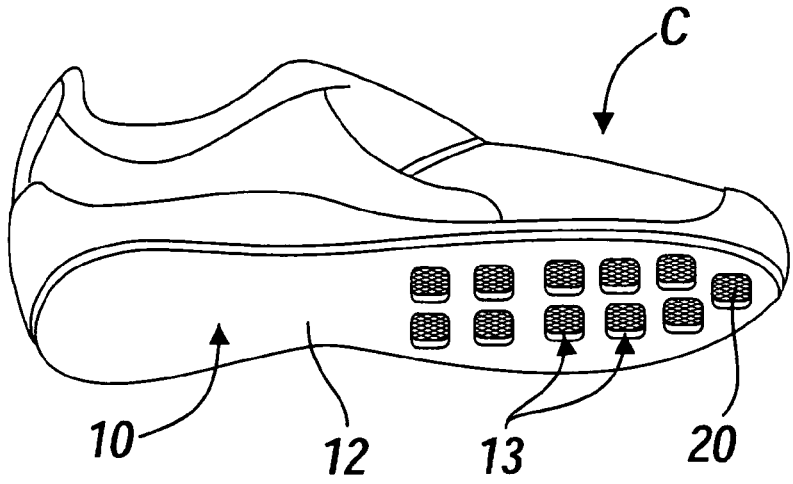
FIG. 1 is a perspective bottom view of a shoe with a sole according to the invention.
Figure 2:
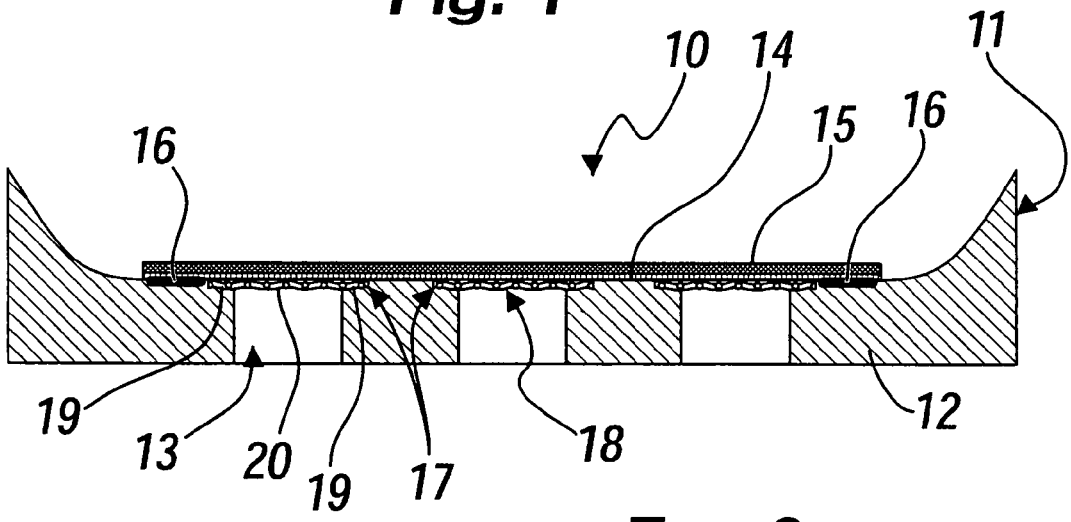
FIG. 2 is a schematic transverse sectional view of a first embodiment of a sole according to the invention.

With reference to FIGS. 1 and 2, a first embodiment of a sole according to the invention is generally designated by the reference numeral 10, while a shoe which uses the sole 10 is generally designated by the reference letter C.

The sole 10 comprises a lower element 11, which is made of plastic material and on which a tread 12 is formed which has a plurality of through holes 13 provided preferably in the region of the sole related to the forefoot.

The through holes 13 are much larger than the small ventilation holes provided on similar soles of the background art and therefore are generally much larger than 2 mm (for example from 5 to 20 mm).

Above the lower element 11, in practice so as to overlap the through holes 13, there is a membrane 14 which is impermeable to water and permeable to water vapor, of a per se known type (such as for example a membrane known by the trade name Gore-Tex®).

According to a known configuration, a mesh 15 made of synthetic material is laminated over the membrane 14.

The membrane 14 is perimetrically joined hermetically in a known manner to at least one component of the sole 10 so as to avoid the rise of liquids through the sole.

This seal, generally designated by the reference numeral 16, is provided for example by gluing the lower perimetric portion of the membrane 14 to the lower element 11 (in practice so as to form a seal from "below" the membrane).

The sole also comprises means 17 for protecting the membrane 14 which are vapor-permeable or perforated and are arranged below the membrane 14, in practice so as to overlap the area of the through holes 13.

Advantageously, the means 17 for protecting the membrane 14 comprise individual vapor-permeable or perforated protective elements 18, each arranged so as to obstruct a corresponding through hole 13.

In particular, the lower element 11 forms, for each through hole 13, an undercut region 19 for preventing downward extraction for each protective element 18.

In this first embodiment, which is clearly visible in the diagram of FIG. 2, the protective elements 18 are flat and are constituted by net elements 20, made for example of metallic or plastic material, which have a larger area than the through holes 13.

The net elements 20 are rigidly coupled to the lower element 11, in this embodiment, by virtue of the overmolding of said lower element 11 on the edges of said net elements 20 arranged in the mold as inserts.

The portions of the lower element 11 that are superimposed on the perimetric edges of the net elements 20 in practice constitute said undercut regions 19 for preventing downward extraction for said net elements 20 (which, as mentioned, constitute the protective elements 18 for the membrane 14).

Figure 3:
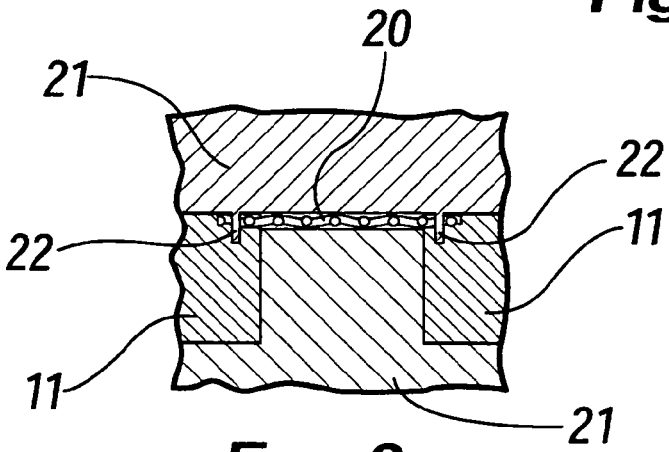
FIG. 3 is a schematic sectional view of a portion of a mold for forming a sole according to the invention, illustrating a portion of said sole.

FIG. 3 is a diagram of a portion of a closed mold 21, which shows internally a portion of a sole related to a net element 20 (the membrane with the mesh will be associated subsequently with said sole).

For precise placement of the net element 20, it is possible to use small pins 22 of the mold 21 onto which each net element 20 is engaged.

Figure 4:
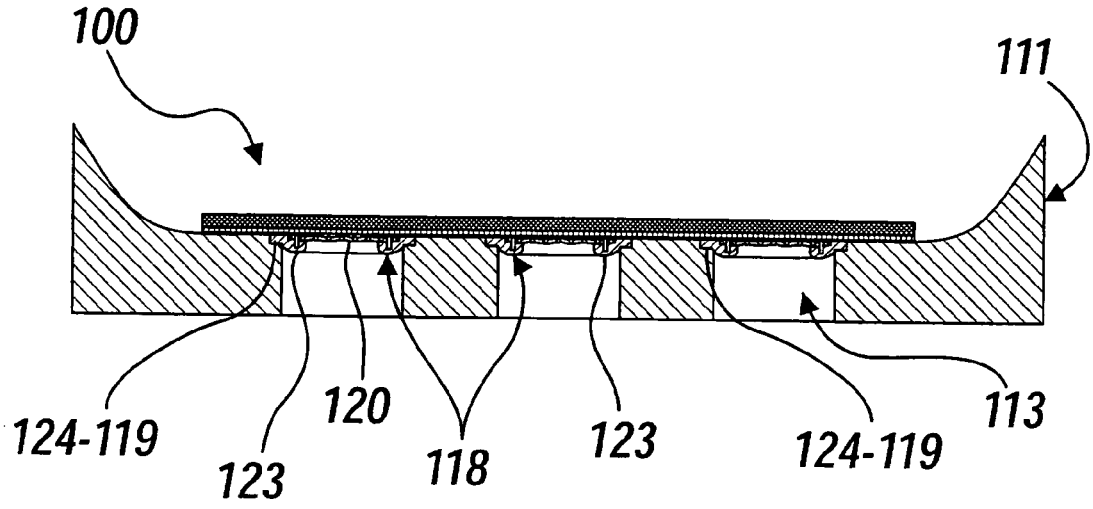
FIG. 4 is a schematic transverse sectional view of a variation of the first embodiment of the sole of FIG. 1.
Figure 5:
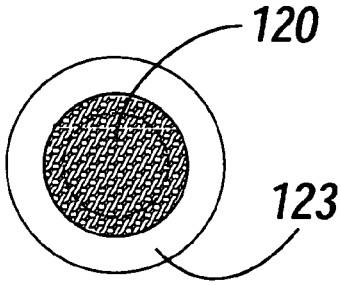
FIG. 5 is a top view of an element for protecting the membrane provided in a sole according to the invention.

A variation to this first embodiment, generally designated by the reference numeral 100 and shown in FIG. 4, provides protective elements, now designated by the reference numeral 118, which are constituted by rings 123 made of plastic material which are closed at the center by net elements 120, as clearly shown in the plan diagram of FIG. 5.

Figure 6:
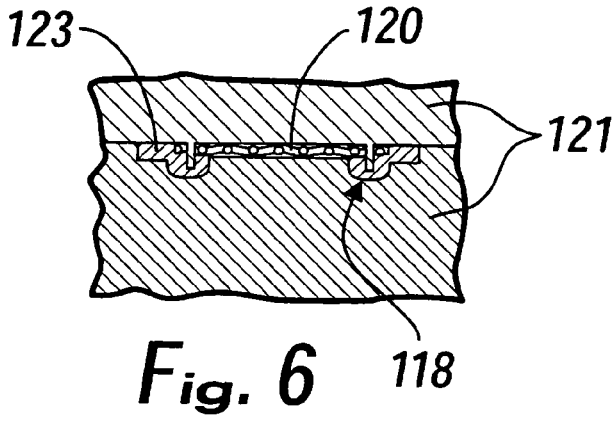
FIG. 6 is a schematic sectional view of a portion of a mold for forming the protective element of FIG. 5.

The method of production of said protective elements 118 may entail overmolding the plastic rings 123 on the peripheral region of the net elements 120 (as shown in the diagram of the mold 121 of FIG. 6) and subsequently, as shown in FIG. 4, gluing said protective elements 118 in annular recesses 124 provided on the upper face of the lower element 111 and at the upper end of each through hole 113; said annular recesses 124 constitute said undercut regions 119 for preventing downward extraction for the protective elements 118.

Figure 7:
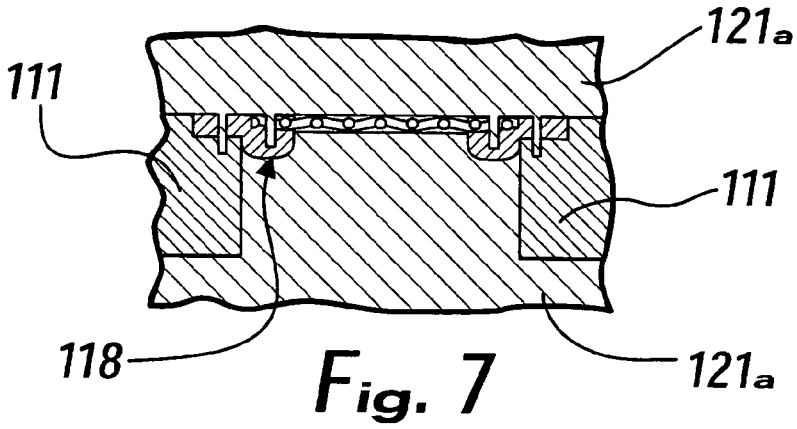
FIG. 7 is a schematic sectional view of portion of a mold for forming a sole according to the invention, which uses the protective element of FIGS. 5 and 6.

Moreover, said protective elements 118 can be used as mold inserts onto which the rest of the sole is to be overmolded, as shown in the diagram of the mold 121*a* of FIG. 7.

It is evident that instead of net elements it is possible to use equivalently other vapor-permeable or fine perforated elements made of a material suitable for the requirements, such as for example microstretched metal sheets, fused and partially compressed synthetic fibers, compressed natural fibers (for example hemp or coconut fibers), leather and other materials.

Figure 8:
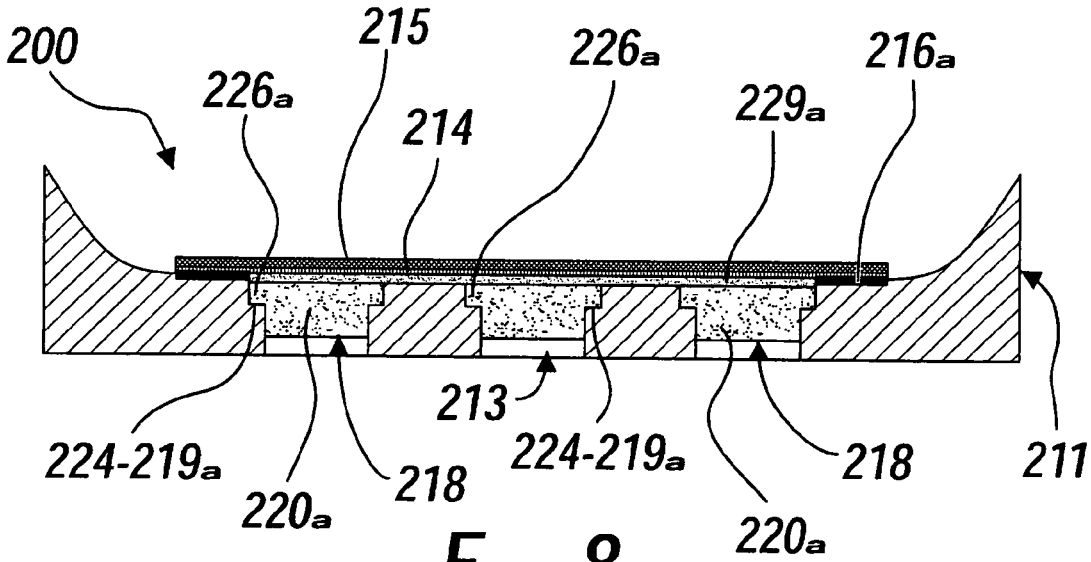
FIG. 8 is a schematic transverse sectional view of a second embodiment of the sole according to the invention.

A second embodiment of a shoe according to the invention, designated by the reference numeral 200 in FIG. 8, uses as protective elements, now designated by the reference numeral 218, vapor-permeable plugs 220*a*, whose contour has a cylindrical symmetry or is substantially shaped like a parallelepiped.

Said vapor-permeable plugs 220*a* are preferably porous plugs of the open-cell type or of the type with sintered microspheres, provided for example by means of sintered granular powders (for example stainless steel, bronze and other metals or alloys), aluminum foams, porous and vapor-permeable plastic materials, ceramic materials et cetera, and in general materials which do not have oxidation phenomena upon contact with water which might compromise their vapor permeability.

A wider step-like portion 226*a* protrudes laterally at the upper end of said plug 220*a* and is adapted to be arranged in annular recesses 224 provided on the upper face of the lower element 211 at the upper end of each through hole 213; said annular recesses 224 constitute said undercut regions 219*a* for preventing downward extraction for the protective elements 218.

Figure 9:
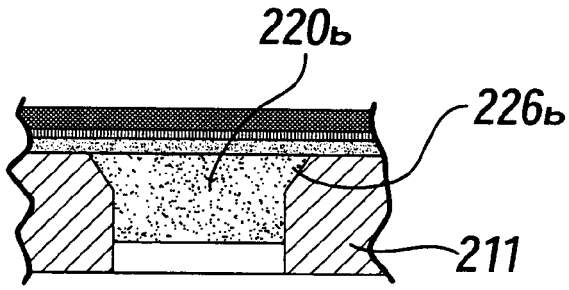
FIG. 9 is a schematic transverse sectional view of a portion of a sole which is a variation with respect to the one of FIG. 8.

Instead of the step-like variation of the wider portion 226*a*, it is possible for example to use a vapor-permeable plug 220*b*, in which the wider portion 226*b* tapers downwardly (see FIG. 9).

Said vapor-permeable plugs 220*a* and 220*b* may be associated with the lower element 211 both by adhesive bonding and by overmolding.

Figure 10:
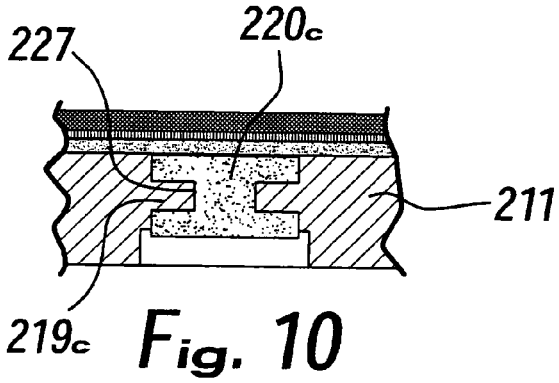
FIG. 10 is a schematic transverse sectional view of portion of a sole which is a variation with respect to the one of FIGS. 8 and 9.

FIG. 10 shows a plug 220*c* which has, in an intermediate lateral position of its axial extension, a recess 227 inside which part of the lower element 211 penetrates so as to provide an undercut region 219*c* for preventing downward extraction.

Figure 11:
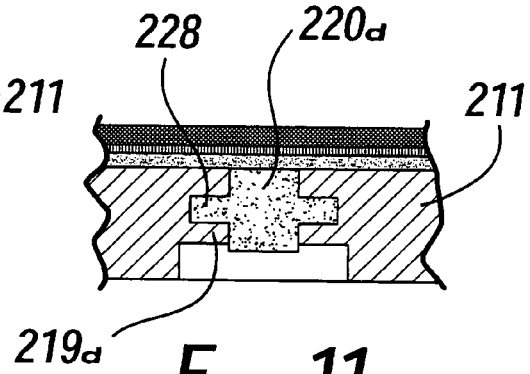
FIG. 11 is a schematic transverse sectional view of a portion of a sole which is a variation with respect to the one of FIGS. 8, 9 and 10.

FIG. 11 shows a plug 220*d*, which has, in an intermediate lateral position of its axial extension, a protrusion 228 which is adapted to penetrate in the matrix of the lower element 211; the part of the lower element 211 that lies below said protrusion 228 constitutes an undercut region 219*d* for preventing downward extraction.

Said vapor-permeable plugs 220*c* and 220*d* are associated with the lower element 211 preferably by overmolding.

Figure 12:
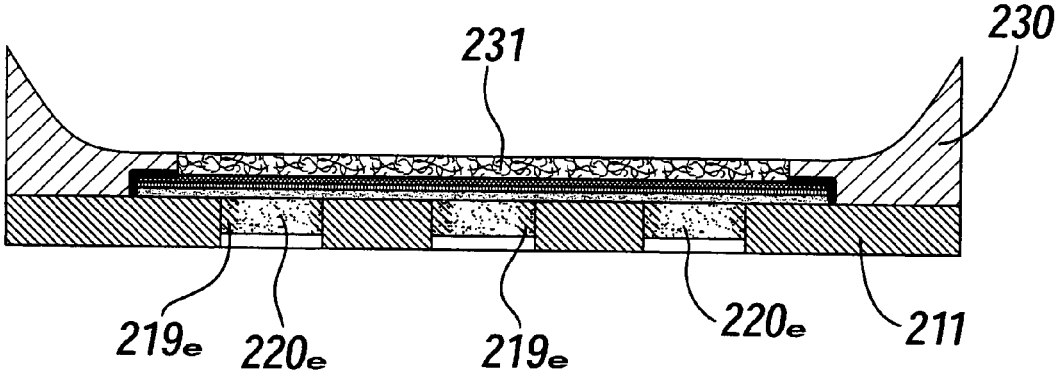
FIG. 12 is a schematic transverse sectional view of a sole which is a variation with respect to the one of FIGS. 8, 9 and 11.

FIG. 12 shows another variation of a vapor-permeable plug, designated by the reference numeral 220*e*.

Said vapor-permeable plug 220*e* is of the porous type and has a completely cylindrical or completely parallelepipedal shape, in practice with substantially vertical side walls.

In this case, the association with the lower element 211 of the vapor-permeable plug 220*e* occurs by overmolding, so that the plastic material of the lower element 211 penetrates laterally part of said plug 220*e* due to the porosity of the surface of said plug.

The portion of the lower element 211 that penetrates the vapor-permeable plug 220*e* constitutes an undercut region 219*e* for preventing downward extraction for said plug (shown in the figure by an overlap of the dashed lines of the lower element 211).

FIG. 8 also illustrates a protective layer 229*a* of the membrane 214 which is additional with respect to the vapor-permeable plugs 220*a*.

Said protective layer 229*a*, which is made for example of a vapor-permeable, water-repellent material which is capable of drying rapidly (for example a woven fabric, a non-woven fabric or pile cloth) mainly has the purpose of protecting the membrane 214 against the abrasion of said protective elements 218 (in this case the plugs 220*a*); said protective layer 229*a* is for example laminated to the membrane 214.

In this embodiment, said protective layer 229*a* has a smaller area than the membrane 214 (but in any case an area which is larger than, or equal to, the total area occupied by the through holes 213), so as to leave free the perimetric edges of said membrane in order to provide the seal 216*a* from "below" of said membrane 214 with the lower element 211.

FIG. 12 shows the case in which the protective layer of the membrane 214, now designated by the reference numeral 219*e*, has the same area as the membrane.

In this case, the seal of the membrane 214 is performed from "above", for example by overmolding a mid-sole 230 which surrounds laterally the membrane and is superimposed on the upper perimetric edges thereof and of the corresponding mesh 215; above the mesh 215 there is a vapor-permeable or perforated filler 231.

Figure 13:
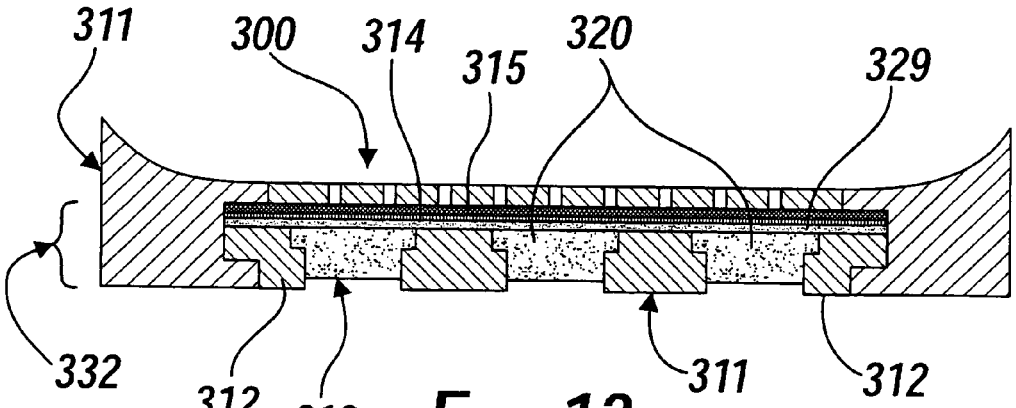
FIG. 13 is a schematic transverse sectional view of a sole which is a variation with respect to the one of FIGS. 8, 9, 11 and 12.

FIG. 13 shows a sole 300, which is constituted by a prepared pack 332 which comprises, from the bottom upwardly, part of the element 311, the protective layer 329, the membrane 314 and the mesh 315; the tread 312 is integrated on said part of the element 311 and is provided with through holes 313, with which vapor-permeable plugs 320 are associated.

The lower element 311, which constitutes the supporting structure of the sole, is provided perimetrically with respect to said prepared pack 332.

Said prepared pack 332 is provided separately and then inserted in the mold as an insert onto which the lower element 311 is overmolded; in this construction, the lower element 311 seals the membrane from "above".

In practice it has been found that the invention thus described solves the problems noted in known types of vapor-permeable and waterproof soles; in particular, the present invention provides a sole for shoes of the waterproof and vapor-permeable type which allows optimum vapor permeability without compromising the characteristics of protection of the membrane and without compromising the flexibility and shock-absorption characteristics of the sole.

This has been achieved by providing through holes in the tread which are larger than the small holes provided in known types of soles and by associating with each hole vapor-permeable elements for protecting the membrane.

Through holes of such size do not allow the accumulation of dirt and therefore maintain their effective shoe ventilation area.

The association of a protective element with each through hole allows to avoid stiffening, in applications where high flexibility is required, the entire sole with a vapor-permeable or perforated structure such as a metallic net associated with a large ventilation hole.

It is evident that it is fundamental for the protective elements of the membrane to be fixed stably to the lower element with which the tread is integrated.

From this standpoint, the provision of an undercut region for preventing downward extraction for each protective element, formed on the lower element of the sole, ensures this stability.

The invention thus conceived is susceptible of numerous modifications and variations, all of which are within the scope of the appended claims; all the details may further be replaced with other technically equivalent elements.

In practice, the materials used, so long as they are compatible with the specific use, as well as the dimensions, may be any according to requirements and to the state of the art.

The disclosures in Italian Patent Application No. TV2006A000104 from which this application claims priority are incorporated herein by reference.

Where technical features mentioned in any claim are followed by reference signs, those reference signs have been included for the sole purpose of increasing the intelligibility of the claims and accordingly, such reference signs do not have any limiting effect on the interpretation of each element identified by way of example by such reference signs.

The invention claimed is:

1. A waterproof and vapor permeable sole for shoes, comprising:

a lower element made of plastic material, on which a tread provided with a plurality of through holes is formed;

a membrane which is impermeable to water and permeable to water vapor and is arranged above said lower element so as to be superimposed on said through holes, said membrane being joined perimetrically and hermetically to at least one component of the sole so as to avoid rise of liquids through said sole;

vapor-permeable or perforated means for protecting said membrane, which are arranged below said membrane so as to be superimposed on the area of said holes, wherein said means for protecting said membrane comprises individual vapor-permeable or perforated protective elements, each arranged so as to block a corresponding said through hole, said lower element forming, for each of said through holes, an undercut region for preventing downward extraction for each of said protective elements, and said membrane overlaps said through holes and is joined perimetrically and hermetically to the lower element to form a single perimetric seal.

2. The sole for shoes according to claim 1, wherein said protective elements are flat and include net elements, which have a larger area than said through holes.

3. The sole for shoes according to claim 2, wherein said net elements are rigidly coupled to said lower element by overmolding of said lower element on edges of said net elements, which are arranged in the mold as inserts, parts of said lower element which are superimposed on the perimetric edges of said net elements, constituting said undercut regions for preventing downward extraction for said net elements.

4. The sole for shoes according to claim 2, wherein said protective elements include rings made of plastic material which are closed at the center by net elements.

5. The sole for shoes according to claim 4, wherein said rings made of plastic material are overmolded on edges of said net elements.

6. The sole for shoes according to claim 4, wherein said protective elements are arranged and glued in annular recesses provided on an upper face of said lower element at an upper end of each of said through holes, said annular recesses constituting said undercut regions for preventing downward extraction for said protective elements.

7. The sole for shoes according to claim 4, wherein said protective elements are rigidly coupled to said lower element by overmolding.

8. The sole for shoes according to claim 2, wherein said net elements are made of metallic or plastic material.

9. The sole for shoes according to claim 1, wherein said protective elements include flat vapor-permeable or microperforated elements, which include microstretched metal sheets, fused and partially compressed synthetic fibers, and compressed natural fibers.

10. The sole for shoes according to claim 1, wherein said protective elements include vapor-permeable plugs, whose shape has a cylindrical symmetry or is mainly that of a parallelepiped.

11. The sole for shoes according to claim 10, wherein said vapor-permeable plugs include metallic powders based on stainless steel or bronze.

12. The sole for shoes according to claim 10, wherein said vapor-permeable plugs are made of materials that do not exhibit oxidation or hydrolysis phenomena upon contact with water.

13. The sole for shoes according to claim 10, wherein a wider portion is provided that protrudes laterally at an upper end of each of said vapor-permeable plugs and is adapted to be arranged in annular recesses provided on an upper face of said lower element at an upper end of each of said through holes.

14. The sole for shoes according to claim 13, wherein said wider portion has a stepwise variation with respect to a main body of the plug.

15. The sole for shoes according to claim 13, wherein said wider portion tapers downwardly.

16. The sole for shoes according to claim 10, wherein each of said plugs includes, in an intermediate lateral position of its axial extension, a recess inside which part of said lower element penetrates so as to provide an undercut region for preventing downward extraction.

17. The sole for shoes according to claim 10, wherein each of said plugs includes, in an intermediate lateral position of its axial extension, a protrusion which is adapted to penetrate the matrix of said lower element.

18. The sole for shoes according to claim 10, wherein each of said vapor-permeable and porous plugs is rigidly coupled to said lower element for penetration of the plastic material thereof on the porous lateral surface of said plug, a portion of the lower element that penetrates the vapor-permeable plug constituting an undercut region for preventing the downward extraction for said plug.

19. The sole for shoes according to claim 18, wherein each plug has a cylindrical or parallelepipedal contour with substantially vertical side walls.

20. The sole for shoes according to claim 1, wherein said protective elements include porous vapor-permeable plugs of open cell type or of sintered microsphere type.

21. The sole for shoes according to claim 20, wherein said vapor-permeable plugs include one or more of the following materials: sintered granular powders, aluminum foams, porous and vapor-permeable plastic materials, ceramic materials, compressed synthetic or natural fibers, leather, and salpa.

22. The sole for shoes according to claim 1, further comprising a protective layer of said membrane, which is vapor-permeable or perforated and is arranged between said membrane and said protective elements.

23. The sole for shoes according to claim 22, further comprising a protective layer which is in direct contact with said membrane.

24. The sole for shoes according to claim 22, wherein said protective layer is made of vapor-permeable and water-repellent material.

25. The sole for shoes according to claim 22, wherein said protective layer is laminated to said membrane.

26. The sole for shoes according to claim 22, wherein said protective layer has a smaller area than said membrane, perimetric edges of said membrane not overlapping the edges of said protective layer, said membrane being sealed from below to said lower element.

27. The sole for shoes according to claim 22, wherein said protective layer has a same area and contour as said membrane, said sole including a mid-sole which surrounds laterally said membrane and is adapted to seal laterally and in an upward region the membrane to avoid rise of fluids.

28. The sole for shoes according to claim 1, further comprising a prepared pack which comprises, from the bottom upwardly, part of said lower element with said tread integrated therein, said tread including said through holes with which said protective elements are associated, and at least said membrane, said lower element being provided perimetrically with respect to said prepared pack and constituting a supporting structure of the sole.

29. The sole for shoes according to claim 1, wherein said through holes have a width ranging from 5 to 20 mm.

30. The sole for shoes according to claim 1, wherein a mesh is laminated onto said membrane.

31. A shoe, comprising a sole according to claim 1.

* * * * *